US005768814A

United States Patent [19]

Kozek et al.

[11] Patent Number: 5,768,814

[45] Date of Patent: Jun. 23, 1998

[54] EXIT SIGN WITH REMOVABLE EMERGENCY POWER PACK MODULE

[75] Inventors: Edward P. Kozek, Woodbury; Robert M. Johnstone, Fairfield, both of Conn.

[73] Assignee: GSEG LLC, Farmington, Conn.

[21] Appl. No.: 97,572

[22] Filed: Jul. 26, 1993

Related U.S. Application Data

[63] Continuation of Ser. No. 591,719, Oct. 2, 1990, abandoned.

[51] Int. Cl.[6] ..... G09F 13/04

[52] U.S. Cl. ..... 40/570; 40/580; 362/20; 362/183

[58] Field of Search ..... 40/570, 572, 573, 40/574, 580, 564; 362/20, 183, 249, 80

[56] References Cited

U.S. PATENT DOCUMENTS

| | | | |
|---|---|---|---|
| 1,081,800 | 12/1913 | Wiley et al. . | |
| 1,469,946 | 10/1923 | Morrison | 40/570 |
| 1,543,168 | 6/1925 | LaRose . | |
| 1,931,577 | 10/1933 | Easterday et al. . | |
| 2,213,584 | 9/1940 | Hulst | 362/20 |
| 3,931,689 | 1/1976 | Schine | 40/570 |
| 4,184,277 | 1/1980 | Larin | 40/600 X |
| 4,271,621 | 6/1981 | Garcia et al. | 40/570 |
| 4,435,743 | 3/1984 | Plumly | 40/574 X |
| 4,650,265 | 3/1987 | Holtzman . | |

FOREIGN PATENT DOCUMENTS 686796 1/1953 United Kingdom .

*Primary Examiner*—Brian K. Green
*Attorney, Agent, or Firm*—Ware, Fressola, Van der Sluys & Adolphson LLP

[57] ABSTRACT

In an exit sign, an insertable battery pack module is designed to fit in the lower portion of the exit sign housing. This battery pack module incorporates a pair of lamps as well as a battery, battery charger and transfer circuitry. The module incorporates a pair of reflective surfaces so that light from lamp filaments tangentially hit at least a portion of the exit sign stenciled area along the bottom portion of the letters forming the word EXIT. If an exit sign is only to have utility AC power, then the module need not be installed within the exit sign. In this configuration, the bottom portion of the exit sign can incorporate a slidable panel which is removed if the battery pack module is later inserted. The battery pack module incorporates the indicator light and test button which then would show through the area where the panel formerly resided. This exit sign provides a clean appearance unlike prior art exit signs wherein the battery backup module is typically added onto the outside of the existing exit sign.

30 Claims, 5 Drawing Sheets

EXIT SIGN WITH REMOVABLE EMERGENCY POWER PACK MODULE

This is a continuation of application Ser. No. 07/591719 filed on Oct. 2, 1990, now abandoned.

BACKGROUND OF THE INVENTION

The present invention relates generally to mounting electrical devices to standard electrical junction boxes found in walls and ceilings and, more particularly, to mounting illuminated exit signs to such electrical boxes.

Under current local fire and building codes, buildings to which the public has access are required to have signage therein identifying the exits. Most of these signs are required to exhibit a specific amount of illumination and, oftentimes, must have an emergency backup power source to provide emergency illumination to the light for a specified period of time during periods when utility power to the building is discontinued, thereby facilitating egress of persons from the building.

Traditionally, two 15-watt incandescent lamps driven by 120 volt alternating current (120 VAC) have been employed to provide normal illumination while two 3.6-watt incandescent lamps driven by a self contained emergency battery power supply are used for illumination during power failure situations. A switching or transfer device will automatically operate the emergency backup illumination system when a power failure is detected.

While these traditional exit sign lighting arrangements perform adequately, they do have a few drawbacks. A major drawback is that the emergency battery power supply and associated transfer circuitry is typically added onto an existing exit sign as an external module. This type of external installation gives a rather cumbersome look to the exit sign. In addition, the same building may contain exit signs with and without battery back-up. It would be desirable if these exit signs all had the same external appearance.

It is an object of the present invention to provide a novel exit sign mounting which has the same external appearance whether or not it has emergency battery power capabilities.

It is also an object to provide such an exit sign having a battery back-up module containing an emergency battery power supply and associated charging and transfer circuitry insertable within the exit sign housing.

Still another object is to provide such an exit sign which can be retrofit with an emergency battery power supply and associated charging and transfer circuitry.

A further object is to provide such an exit sign which may be readily and economically fabricated and will enjoy a long life in operation.

SUMMARY OF THE INVENTION

It has now been found that the foregoing and related objects can be readily attained in an exit sign assembly adapted for attachment to an electrical junction box found in a wall or ceiling of a building comprising an exit sign housing with indicia thereon, a mounting device for attaching the housing to the electrical junction box, and primary and emergency illumination devices mounted in the housing for illuminating the indicia. The primary illumination device has low voltage primary lamps to fully illuminate the indicia in a uniform manner and a primary electric power circuit operationally connected to low voltage primary lamps for supplying power thereto. The emergency illumination module is operationally connected to the primary illumination device to detect failure thereof and thereafter provide auxiliary illumination to the indicia. The emergency illumination module is provided with an emergency power pack housing, low voltage emergency lamps mounted on the emergency power pack housing, an emergency electric power supply located within the emergency power pack housing and operationally connected to the low voltage emergency lamps for supplying power thereto, and an emergency electric power circuit within the emergency power pack housing for detecting failure of the primary electric power circuit and for switching to the emergency electric power supply.

Desirably, the emergency electric power supply is provided by a plurality of rechargeable batteries. The emergency electric power circuit includes a charging device for keeping the rechargeable batteries fully charged during periods of nonuse.

Conveniently the exit sign housing has a generally rectangular shape including a rectangularly shaped frame with at least one removable cover thereon. The rectangularly shaped frame has top and bottom walls and a pair of endwalls.

Ideally, the emergency illumination module is slideably received yet firmly seated within the frame. The exit sign housing and the emergency power pack housing are dimensionally sized so as to prevent relative movement therebetween when the emergency illumination module is fully inserted in the exit sign housing. The emergency illumination module is an integral unit to facilitate insertion and replacement thereof.

According to the invention, the emergency power pack housing includes a dovetailed male member designed to cooperate with a dovetailed reception area of the exit sign housing within which the dovetailed male member is slideably received. The emergency electric power circuit includes a test switch and indicator light while the dovetailed male member includes at least one aperture through which the test switch and the indicator light protrude so as to be external to the emergency power pack housing. The exit sign housing has an access opening defined therein to provide access to the test switch and indicator light from outside the exit sign housing.

Still another feature of the invention is the provision of an access plate mountable in the exit sign housing when the emergency illumination module is not mounted therein. The access plate has a dovetailed shape so as to be slideably receivable within the dovetailed reception area to cover the access opening.

In yet another feature, the emergency power pack housing has at least one angled side wall positioned within the exit sign housing to receive light rays from both the low voltage primary lamps and the low voltage emergency lamps and reflect the light rays so received to illuminate the indicia. The low voltage emergency lamps and the low voltage primary lamps are mounted within the exit sign housing on opposite sides thereof.

The invention will be fully understood when reference is made to the following detailed description taken in conjunction with the accompanying drawings.

DETAILED DESCRIPTION OF THE PREFERRED EMBODIMENT

Figure 1:
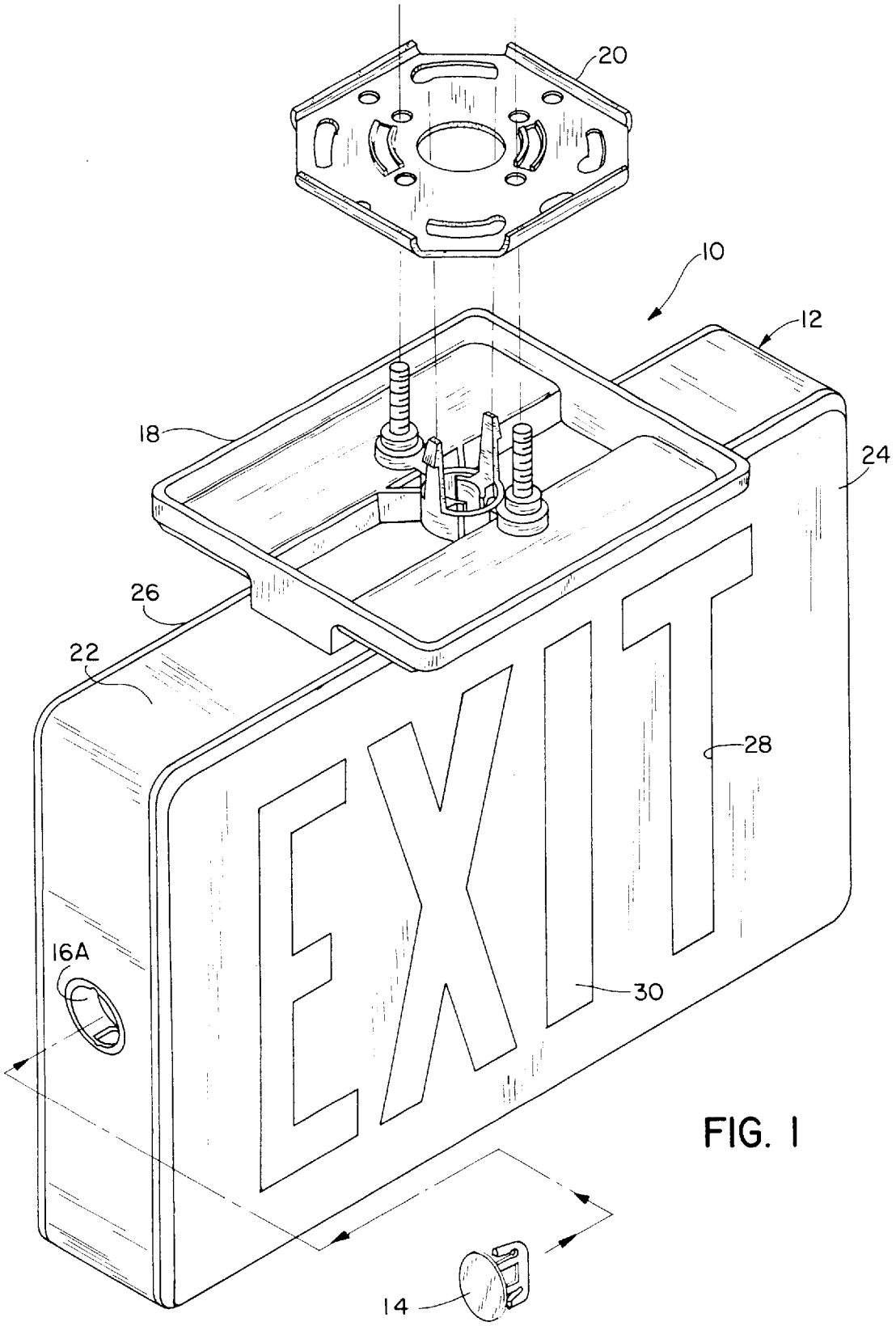
FIG. 1 is a partially exploded perspective view of an exit sign embodying the present invention.

Referring first to FIG. 1 of the drawings, therein illustrated is the exit sign construction of this invention generally designated by the numeral 10. The exit sign 10 has an exit sign housing generally indicated by the numeral 12 shown with a flush mounted hole plug 14 mountable to the side thereof in elongated opening 16A, a canopy bracket 18 mounted to the top of the exit sign housing 12, and a universal mounting plate 20 mountable to both the canopy bracket 18 and a standard electrical junction box in a manner explained in copending U.S. patent application Ser. No. 07/585,610 filed Sep. 20, 1990, entitled CANOPY MOUNTING DEVICE FOR EXIT SIGNS AND THE LIKE of inventor Robert M. Johnstone. With this arrangement, the exit sign construction of this invention can be mounted directly to a standard electrical junction box found in a ceiling of a building in any desired location.

The exit sign housing 12 comprises a central rectangularly shaped frame 22 with front and back cover members 24 and 26, at least one of which incorporates a large stencil 28 having the letters "EXIT" in the major surface thereof and a colored plastic diffuser 30 therebehind. The central rectangularly shaped frame 22 and the front and back cover members 24 and 26 are snap-fit together and cooperate to form an enclosure (FIG. 2) generally indicated by the numeral 32 containing the necessary internal electrical lighting components. The front and back covers 24, 26 can use a plurality of finger clips 31 (one shown in both FIGS. 2 and 3) to hold them in assembly with the central rectangularly shaped frame 22.

In the alternative arrangement of the exit sign construction of this invention not illustrated herein but shown in the copending application, the flush mounted hole plug 14 can be mounted to the top of the housing 12 within an elongated opening 16B defined in the rectangularly shaped frame 22, while the canopy bracket 18 is mounted to the side of the central rectangularly shaped frame 22 within the elongated opening 16A. With this arrangement, the exit sign construction of this invention can be mounted directly to a standard electrical junction box located in a side wall of a building in any desired location.

In addition to the two previously mentioned mounting arrangements using the canopy bracket 18, another nonillustrated arrangement can be used where the exit sign unit of the present invention can be adapted for flush mounting on a side wall directly to a standard electrical junction box. By eliminating the canopy bracket IS and using a screwdriver to punch out the areas of weakness 34 in the back cover member 26, the back cover member 26 can be attached directly to the electrical junction box by appropriate fasteners such as screws (not shown) and appropriate electrical wires can be threaded through the back cover member 26. A pair of the flush mounted hole plugs 14 could then be inserted in the elongated openings 16A and 16B.

Figure 2:
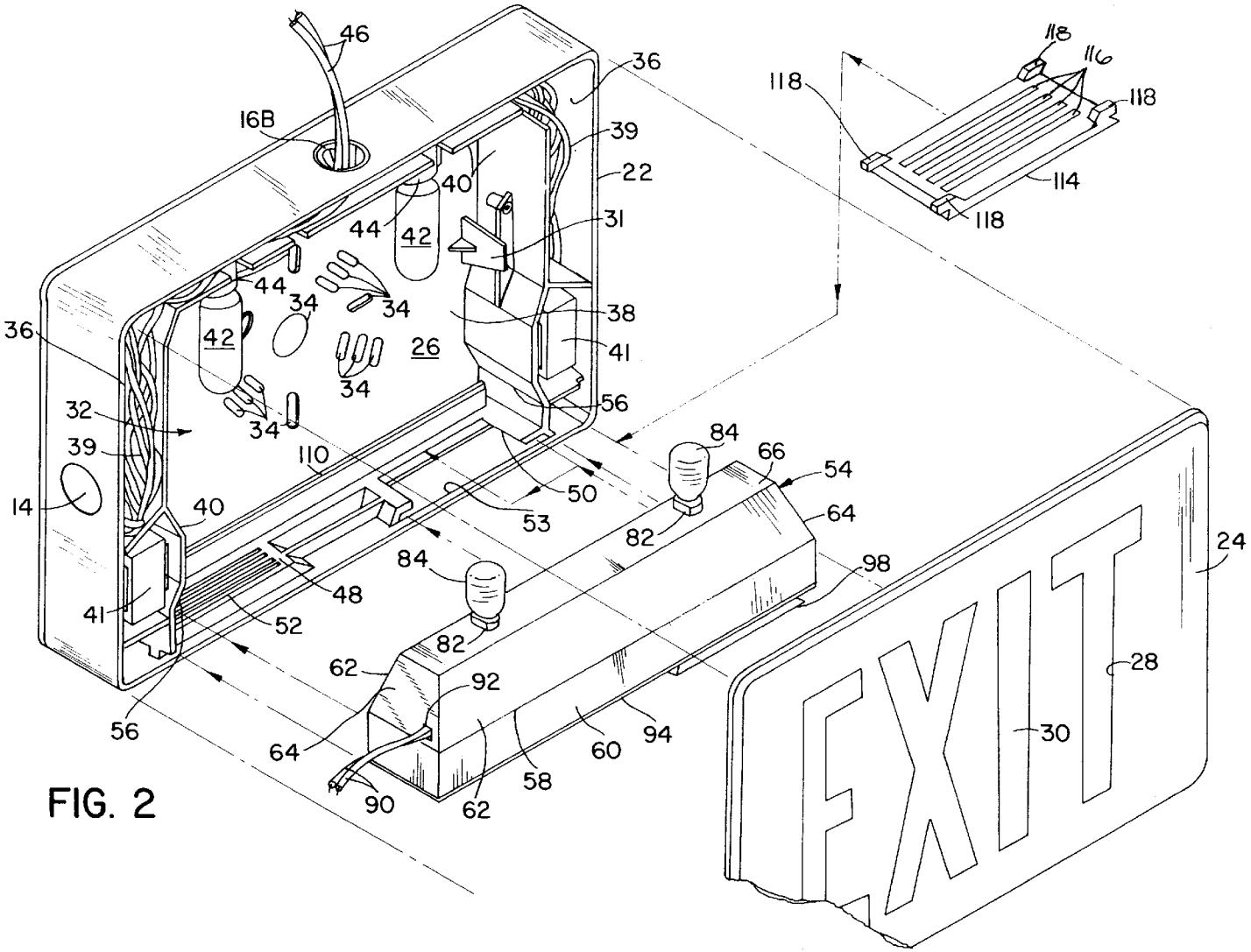
FIG. 2 is a partially exploded perspective view of the exit sign housing showing both its associated emergency power pack module and its optional access plate.

Referring now to FIG. 2, the enclosure 32 of the central exit sign housing 12 is divided into a wiring compartment 36 and a lighting compartment 38 by a retaining wall 40 which extends around the interior sides and top of the central rectangularly shaped frame 22. The wiring compartment 36 contains appropriate wiring harness 39 and transformers 41 for powering two 15-watt alternating current incandescent primary lamps 42 held by lamp sockets 44 extending downwardly into the lighting compartment 38 from the retaining wall 40. Utility power (120 VAC) is provided to the wiring harness 39 of the exit sign 10 through electrical leads 46 which extend into an electrical junction box (not shown) found in the ceiling of the building.

Figure 3:
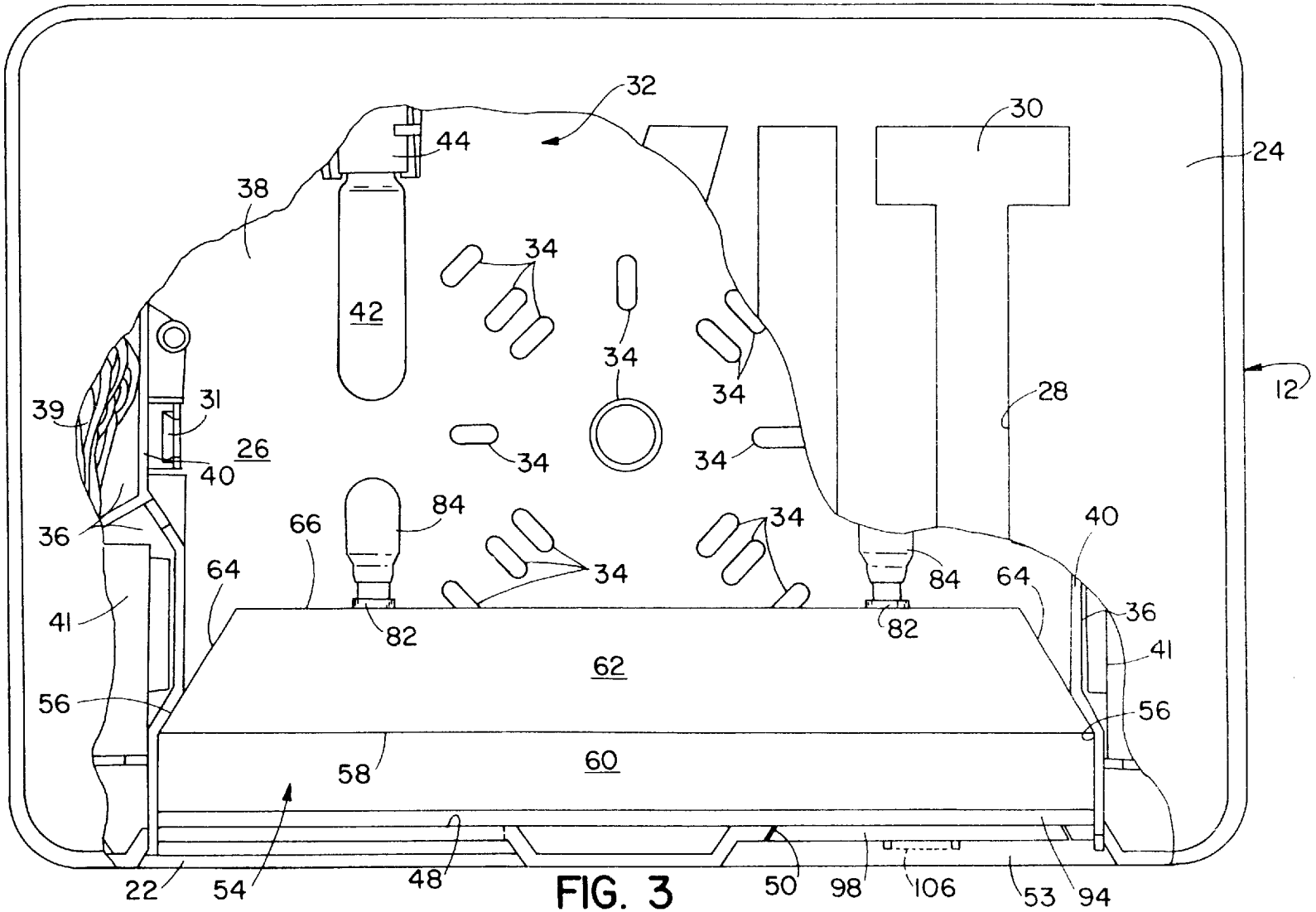
FIG. 3 is a side elevational view of the exit sign housing with a portion of one of the housing members broken away to illustrate internal structure.

Located at the bottom of the lighting compartment 38 is a emergency power pack module retention platform 48 having a dovetailed slide reception area 50 at one end thereof and appropriate vents 52 at the other end thereof. The dovetailed slide reception area 50 has a large generally rectangular opening 53 defined therein. As best seen in FIGS. 2 and 3, the emergency power pack module retention platform 48 is designed to receive an emergency power pack module generally indicated by the numeral 54 with the retaining wall 40 angled as indicated by numeral 56 to accommodate the specific angled shape of the emergency power pack module 54. In its retained position, the emergency power pack module 54 is fully housed within the enclosure 32 of the exit sign housing 12.

Figure 4:
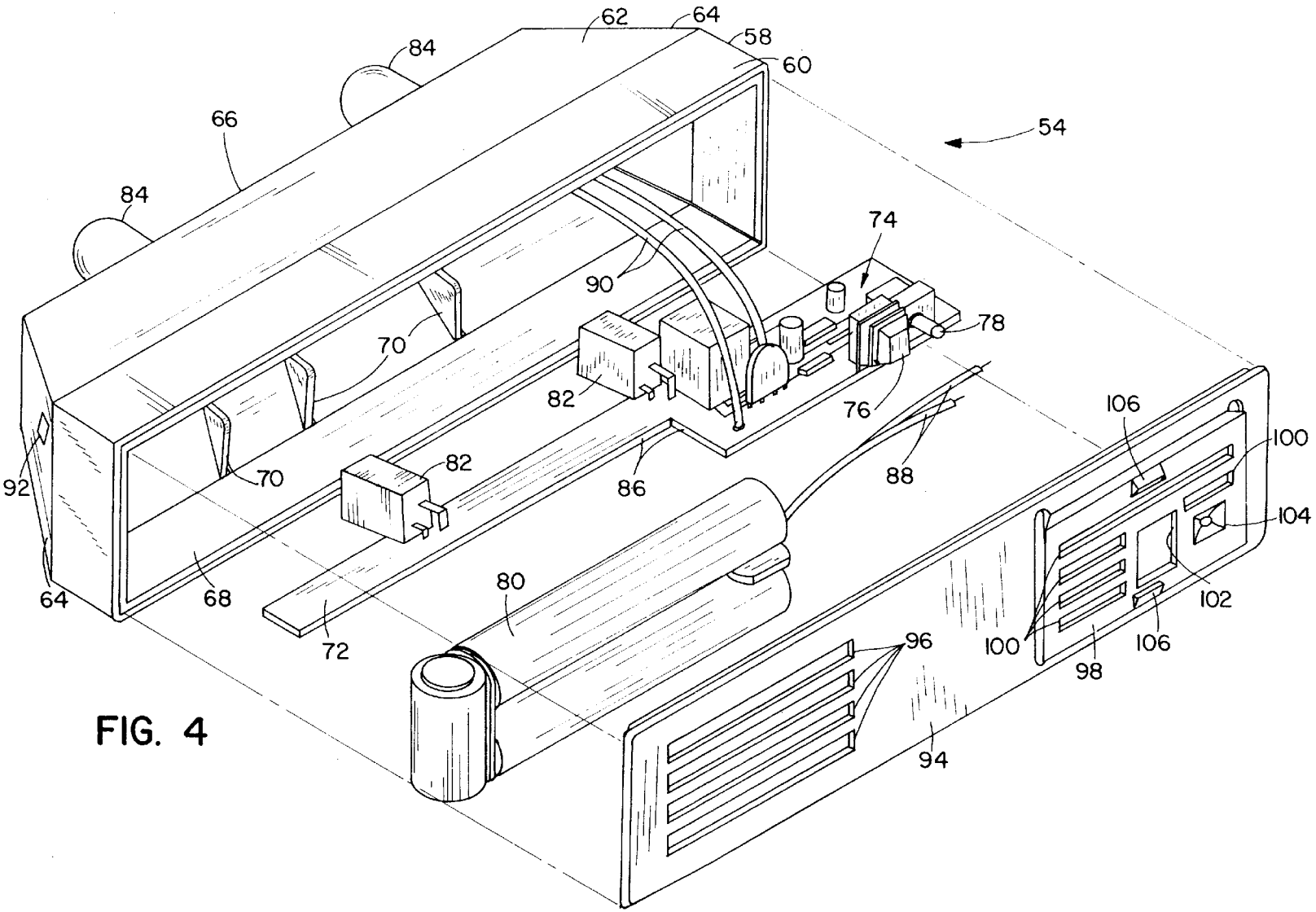
FIG. 4 is an exploded perspective view of the emergency power pack module for the exit sign.

Turning now to FIG. 4, the emergency power pack module 54 is shown in greater detail and includes a hollow power pack cover 58 having a rectangular base 60 with sloped reflective side walls 62, sloped end walls 64 and a flat top wall 66. A contoured foam insert 68 is located within the power pack cover 58 for heat insulating purposes. Adhesively mounted within the power pack cover 58 on mounting tabs 70 is a printed circuit board 72. The printed circuit board 72 incorporates appropriate electronic components and circuitry generally indicated by the numeral 74 in the form of an emergency power supply transformer, rectifier, transfer circuitry, battery charging circuitry, a test switch 76 and indicator lamp 78. The electronic components and circuitry 74 are designed and mounted to the printed circuit board 72 in a manner well known to those skilled in the art to charge the auxiliary rechargeable battery pack 80 as well as to switch between the primary alternating current power supply and the emergency direct power supply provided by the rechargeable battery pack 80 if the alternating current power supply fails as would be the case during a utility power outage. The test switch 76 is used to test the operability of the emergency power supply.

The printed circuit board 72 also has a pair of direct current lamp sockets 82 which extend through the flat top wall 66 and hold a pair of 3.6-watt direct current incandescent emergency lamps 84. The rechargeable battery pack 80, seated within the power pack cover 58 in notch 86 of the printed circuit board 72, is wired to the electronic components and circuitry 74 by use of electrical leads 88. Alternating current is supplied to the electronic components and circuitry 74 by electrical leads 90 which extend from the power pack cover 58 through aperture 92 and are connected to the wiring harness 39. A power pack base 94 is snap assembled on the bottom of the power pack cover 58 to complete the emergency power pack housing thereby enclosing the printed circuit board 72 and rechargeable battery pack 80.

The power pack base 94 has four longitudinally extending vents 96 at one end thereof dimensionally sized to align with the vents 52 of the emergency power pack module retention platform 48 when the emergency power pack module 54 is inserted within the exit sign housing 12. At the other end of the power pack base 94 is a dovetailed slide member 98 having five longitudinally extending vents 100, switch aperture 102 for the test switch 76 indicator light aperture 104 for the indicator light 78 and opposed detents 106. The four longitudinally extending vents 96 and the five longitudinally extending vents 100 provide for air circulation through the emergency power pack module 54 to dissipate heat buildup therein caused by the electronic components and circuitry 74 and the rechargeable battery pack 80.

Figure 5:
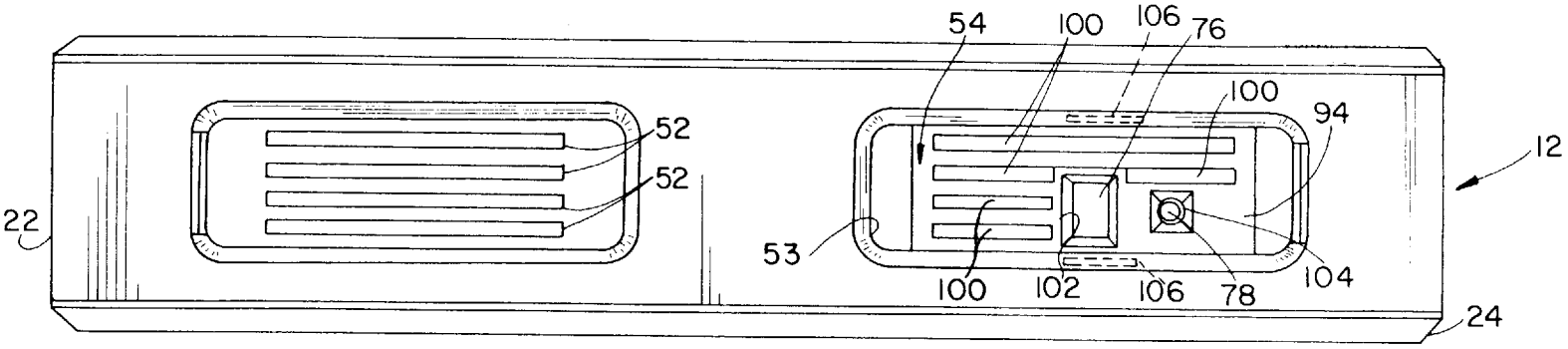
FIG. 5 is a bottom elevational view of the exit sign.
Figure 6:
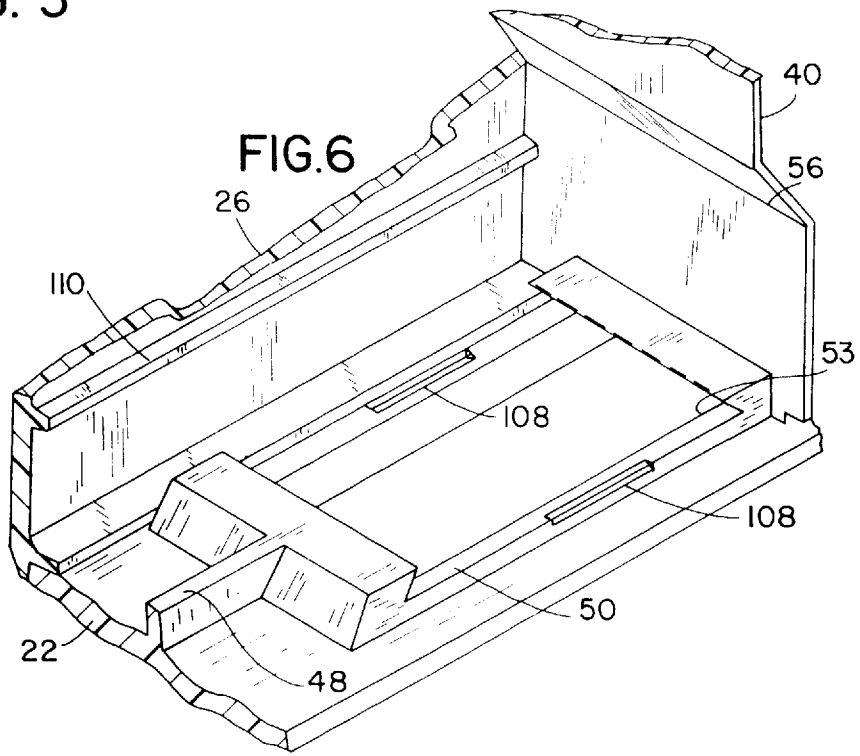
FIG. 6 is a partial perspective view of the exit sign housing showing the dovetailed slide reception area.
Figure 7:
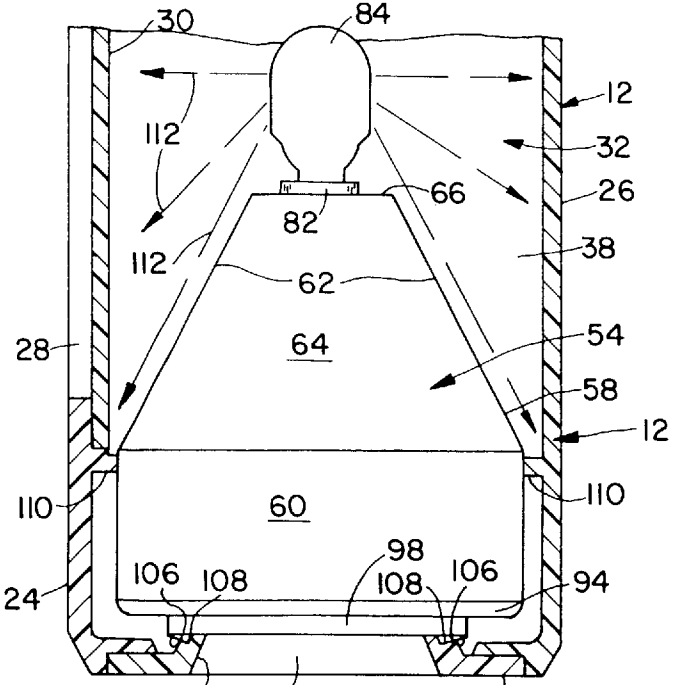
FIG. 7 is a partial side elevational view of the exit sign housing with a portion broken away to illustrate the mating of the detents on the emergency power pack with the housing.

As best understood from FIGS. 3, 6 and 7, the dovetailed slide member 98 on the emergency power pack module 54 is received in the dovetailed slide reception area 50 of the emergency power pack module retention platform 48 with its opposed detents 106 mating with opposed grooves 108 to properly center the emergency power pack module 54 within the exit sign housing 12. When the front cover member 24 and back cover member 26 are snap fit onto the central rectangularly shaped frame 22, longitudinally extending ribs 110 thereon engage the rectangular base 60 of the emergency power pack module 54 to prevent lateral movement of the same. As also seen in greater detail in FIG. 5, with the emergency power pack module 54 fully inserted in the exit sign housing 12, access to the test switch 76 and visual observation of indicator light 78 by the user are permitted through the rectangular opening 53 in the frame 22.

As seen in FIG. 7, the sloped reflective side walls 62 of the emergency power pack module 54 permit light rays 112 from the direct current incandescent emergency lamps 84 to illuminate the stencil 28 when they pass through the diffuser 30 as do the light rays from the primary lamps 42 which reflect from surfaces 62 to evenly illuminate the indicia. It should be appreciated that the sloped reflective side walls 62 are angled and placed so that some of the light rays from the emergency lamps and also the light rays (not shown) from the primary lamps 42 are reflected off the sloped reflective side walls 62 so as to indirectly illuminate the stencil 28.

Turning again to FIG. 2, those skilled in the art will appreciate that a dovetailed access plate 114 can be installed in the dovetailed slide reception area 50 of the emergency power pack module retention platform 48 if the user elects not to use the emergency power pack module 54. The dovetailed access plate 114 has vents 116 providing ventilation to the enclosure 32 and four finger members 118 to hold the dovetailed access plate 114 in place within the dovetailed slide reception area 50.

The mounting plate 20 is preferably stamped from corrosion-resistant sheet metal alloy material such as galvanized steel. The canopy bracket 18, exit sign housing 12, emergency power pack module housing components and the hole plug 14 are preferably molded from a plastic resin such as an engineering type thermoplastic such as ABS, polycarbonate or polyphelyene oxide but it should be apparent to those skilled in the art that they may be manufactured from other suitable materials which exhibit the desired resiliency to permit the desired flexing movement of the various elements.

It will therefore be seen from the above that the present invention provides an effective means for providing an attractive exit sign having a self contained emergency power pack module directly insertable within the housing of the exit sign. The exit sign has the same attractive look whether or not the emergency power pack is used.

It will thus be seen that the objects set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the invention which, as a matter of language, might be said to fall therebetween.

What is claimed is:

1. An exit sign assembly adapted for attachment to an electrical junction box found in a wall or ceiling of a building, comprising:

A. an exit sign housing defining an exit sign housing enclosure therein and including means defining indicia thereon;

B. means on said exit sign housing adapting said exit sign housing for attachment to the electrical junction box;

C. primary illumination means mounted within said exit sign housing enclosure comprising:

i. at least one low voltage primary lamp mounted within said exit sign housing enclosure to fully illuminate said indicia defining means in a uniform manner; and ii. a primary electric power circuit operationally connected to said at least one low voltage primary lamp for supplying power to said at least one low voltage primary lamp; and D. emergency illumination means mounted within said exit sign housing enclosure and operationally connected to said primary illumination means to detect failure thereof and thereafter provide auxiliary illumination to said indicia defining means comprising:

i. an emergency power pack housing defining an emergency power back housing enclosure therein;

ii. at least one low voltage emergency lamp mounted on said emergency power pack housing;

iii. an emergency electric power supply located within said emergency power pack housing enclosure and operationally connected to said at least one low voltage emergency lamp for supplying power to said at least one low voltage emergency lamp; and iv. an emergency electric power circuit within said emergency power pack housing enclosure for detecting failure of said primary electric power circuit and for switching to said emergency electric power supply, wherein said emergency illumination means is an integral unit releasably mounted in said exit sign housing to facilitate replacement thereof.

2. The exit sign assembly in accordance with claim 1, wherein said emergency electric power supply is at least one rechargeable battery.

3. The exit sign assembly in accordance with claim 2, wherein said emergency electric power circuit includes a charging device for keeping said at least one rechargeable battery fully charged during periods of nonuse.

4. The exit sign assembly in accordance with claim 1, wherein said exit sign housing has a generally rectangular shape including a rectangularly shaped frame with at least one removable cover thereon to form said enclosure.

5. The exit sign assembly in accordance with claim 4, wherein said rectangularly shaped frame has top and bottom walls and a pair of endwalls.

6. The exit-sign assembly in accordance with claim 1, wherein said exit sign housing and said emergency power pack housing are dimensionally sized so as to prevent relative movement therebetween.

7. The exit sign assembly in accordance with claim 1, wherein said indicia defining means includes a visible area through which light can pass from said low voltage primary and emergency lamps so as to make the visible area visible outside said exit sign housing enclosure and a masked area which blocks light from said primary and emergency lamps from passing outside said exit sign housing enclosure.

8. The exit sign assembly in accordance with claim 7, further including a diffuser within said exit sign housing enclosure whereby light from said primary and emergency lamps passes through said diffuser before passing out of said exit sign housing through said visible areas.

9. An exit sign assembly adapted for attachment to an electrical junction box found in a wall or ceiling of a building, comprising:

A. an exit sign housing defining an exit sign housing enclosure therein and including means defining indicia thereon, said exit sign housing has a generally rectangular shape including a rectangularly shaped frame with at least one removable cover thereon to form said exit sign housing enclosure;

B. means on said exit sign housing adapting said exit sign housing for attachment to the electrical junction box;

C. primary illumination means mounted within said exit sign housing enclosure comprising:

i. at least one low voltage primary lamp mounted within said exit sign housing enclosure to fully illuminate sad indicia defining means in a uniform manner; and ii. a primary electric power circuit operationally connected to said at least one low voltage primary lamp for supplying power to said at least one low voltage primary lamp;

D. emergency illumination means mounted within said exit sign housing enclosure and operationally connected to said primary illumination means to detect failure thereof and thereafter provide auxiliary illumination to said indicia defining means, said emergency illumination means is slideably received within said frame the emergency illumination means comprising:

i. an emergency power pack housing defining an emergency power pack housing enclosure therein;

ii. at least one low voltage emergency lamp mounted on said emergency power pack housing;

iii. an emergency electric power supply located within said emergency power pack housing enclosure and operationally connected to said at least one low voltage emergency lamp for supplying power to said at least one low voltage emergency lamp; and iv. an emergency electric power circuit within said emergency power pack housing enclosure for detecting failure of said primary electric power circuit and for switching to said emergency electric power supply.

10. The exit sign assembly in accordance with claim 9, wherein said emergency illumination means is firmly seated within said frame.

11. An exit sign assembly adapted for attachment to an electrical junction box found in a wall or ceiling of a building comprising:

A. an exit sign housing defining an enclosure therein and including means defining indicia thereon;

B. means on said housing adapting said housing for attachment to the electrical junction box;

C. primary illumination means mounted within said enclosure comprising:

at least one low voltage primary lamp mounted within said enclosure to fully illuminate said indicia defining means in a uniform manner; and ii. a primary electric power circuit operationally connected to said at least one low voltage primary lamp for supplying power to said at least one low voltage primary lamp; and D. emergency illumination means mounted within said enclosure and operationally connected to said primary illumination means to detect failure thereof and thereafter provide auxiliary illumination to said indicia defining means comprising:

i. an emergency power pack housing;

ii. at least one low voltage emergency lamp mounted on said emergency power pack housing;

iii. an emergency electric power supply located within said emergency power pack housing and operationally connected to said at least one low voltage emergency lamp for supplying power to said at least one low voltage emergency lamp; and iv. an emergency electric power circuit within said emergency power pack housing for detecting failure of said primary electric power circuit and for switching to said emergency electric power supply, wherein said exit sign housing and said emergency power pack housing are dimensionally sized so as to prevent relative movement therebetween, one of said exit sign housing and said emergency power pack housing includes a dovetailed male member and the other of said exit sign housing and said emergency power pack housing has a dovetailed reception area within which said dovetailed male member is slideably received.

12. The exit sign assembly in accordance with claim 11, wherein said dovetailed male member is on said emergency power pack housing.

13. The exit sign assembly in accordance with claim 12, wherein said emergency electric power circuit includes a test switch and indicator light and said dovetailed male member includes at least one aperture through which said test switch and said indicator light protrude so as to be externally accessible through said emergency power pack housing.

14. The exit sign assembly in accordance with claim 13, wherein said exit sign housing has at least one access opening defined therein to provide access to said test switch and indicator light.

15. An exit sign assembly adapted for attachment to an electrical junction box found in a wall or ceiling of a building, comprising:

A. an exit sign housing defining an exit sign housing enclosure therein and including means defining indicia thereon;

B. means on said exit sign housing adapting said exit sign housing for attachment to the electrical junction box;

C. primary illumination means mounted within said exit sign housing enclosure comprising:

i. at least one low voltage primary lamp mounted within said exit sign housing enclosure to fully illuminate said indicia defining means in a uniform manner; and ii. a primary electric power circuit operationally connected to said at least one low voltage primary lamp for supplying power to said at least one low voltage primary lamp; and D. emergency illumination means mounted within said exit sign housing enclosure and operationally connected to said primary illumination means to detect failure thereof and thereafter provide auxiliary illumination to said indicia defining means comprising:

i. an emergency power pack housing defining an emergency power back housing enclosure therein, said emergency power pack housing includes at least ine aperture;

ii. at least one low voltage emergency lamp mounted on said emergency power pack housing;

iii. an emergency electric power supply located within said emergency power pack housing enclosure and operationally connected to said at least one low voltage emergency lamp for supplying power to said at least one low voltage emergency lamp; and iv. an emergency electric power circuit within said emergency power pack housing enclosure for detecting failure of said primary electric power circuit and for switching to said emergency electric power supply, said emergency electric power circuit includes a test switch and indicator light which protrude through said at least one aperture of said emergency power pack housing so as to be externally accessible.

16. The exit sign assembly in accordance with claim 15, wherein said exit sign housing has at least one access opening defined therein to provide access to said test switch and indicator light.

17. An exit sign assembly adapted for attachment to an electrical function box found in a wall or ceiling of a building, comprising:

A. an exit sign housing defining a next sign housing enclosure therein and including means defining indicia thereon;

B. means on said exit sign housing adapting said exit sign housing for attachment to the electrical junction box;

C. primary illumination means mounted within said exit sign housing enclosure comprising:

i. at least one low voltage primary lamp mounted within said exit sign housing enclosure to fully illuminate said indicia defining means in a uniform manner; and ii a primary electric power circuit operationally connected to said at least one low voltage primary lamp for supplying power to said at least one low voltage primary lamp; and D. emergency illumination means mounted within said exit housing enclosure and operationally connected to said primary illumination means to detect failure thereof and thereafter provide auxiliary illumination to said indicia defining means comprising:

i. an emergency power pack housing defining an emergency power pack housing enclosure therein;

ii. at least one low voltage emergency lamp mounted on said emergency power pack housing;

iii. an emergency electric power supply located within said emergency power pack housing enclosure and operationally connected to said at least one low voltage emergency lamp for supplying power to said at least one low voltage emergency lamp; and iv. an emergency electric power circuit within said emergency power pack housing enclosure for detecting failure of said primary electric power circuit and for switching to said emergency electric power supply, wherein said emergency power pack housing has at least one angled side wall positioned within said exit sign housing enclosure to receive light rays from said low voltage primary and emergency lamps and reflect the light rays so received to illuminate said indicia defining means.

18. The exit sign assembly in accordance with claim 17, wherein said at least one low voltage emergency lamp and said at least one low voltage primary lamp are mounted within said exit sign housing enclosure on opposite sides thereof.

19. An exit sign kit adapted for attachment to an electrical junction box found in a wall or ceiling of a building, comprising:

A. an exit sign housing defining an exit sign housing enclosure therein and including means defining indicia thereon;

B. means on said exit sign housing adapting said exit sign housing for attachment to the electrical junction box;

C. primary illumination means mounted within said exit sign housing enclosure comprising:

i. at least one low voltage primary lamp mounted within said exit sign housing enclosure to fully illuminate said indicia defining means in a uniform manner; and ii. a primary electric power circuit operationally connected to said at least one low voltage primary lamp for supplying power to said at least one low voltage primary lamp;

D. emergency illumination means mountable within said exit sign housing enclosure and adapted for operational connection to said primary illumination means to detect failure thereof and thereafter provide auxiliary illumination to said indicia defining means comprising:

i. an emergency power pack housing defining an emergency power pack housing enclosure therein;

ii. at least one low voltage emergency lamp mounted on said emergency power pack housing;

iii. an emergency electric power supply located within said emergency power pack housing enclosure and operationally connected to said at least one low voltage emergency lamp for supplying power to said at least one low voltage emergency lamp; and iv. an emergency electric power circuit within said emergency power pack housing enclosure for detecting failure of said primary electric power circuit and for switching to said emergency electric power supply; and E. an access plate mountable on said exit sign housing when said emergency illumination means is not mounted within said exit sign housing enclosure.

20. The exit sign kit in accordance with claim 19, wherein said emergency illumination means is an integral unit releasably mountable in said exit sign housing to facilitate replacement thereof.

21. The exit sign kit in accordance with claim 19, wherein said exit sign housing and said emergency power pack housing are dimensionally sized so as to prevent relative movement therebetween when said emergency illumination means is fully inserted in said exit sign housing enclosure.

22. The exit sign kit in accordance with claim 19, wherein said emergency electric power circuit includes a test switch and indicator light and said emergency power pack housing includes at least one aperture through which said test switch and indicator light protrude so as to be externally accessible.

23. The exit sign kit in accordance with claim 22, wherein said exit sign housing has at least one access opening defined therein to provide access to said test switch and indicator light.

24. The exit sign kit in accordance with claim 23, wherein said access plate is dimensionally sized to cover said at least one access opening.

25. The exit sign kit in accordance with claim 19, wherein said emergency power pack housing has at least one angled side wall positioned within said exit sign housing enclosure to receive light rays from said low voltage primary and emergency lamps and reflect the light rays so received to illuminate said indicia defining means.

26. An exit sign kit adapted for attachment to an electrical junction box found in a wall or ceiling of a building, comprising:

A. an exit sign housing defining an enclosure therein and including means defining indicia thereon;

B. means on said housing adapting said housing for attachment to the electrical junction box;

C. primary illumination means mounted within said enclosure comprising:

i. at least one low voltage primary lamp mounted within said enclosure to fully illuminate said indicia defining means in a uniform manner; and ii. a primary electric power circuit operationally connected to said at least one low voltage primary lamp for supplying power to said at least one low voltage primary lamp;

D. emergency illumination means mountable within said enclosure and adapted for operational connection to said primary illumination means to detect failure thereof and thereafter provide auxiliary illumination to said indicia defining means comprising:

i. an emergency power pack housing;

ii. at least one low voltage emergency lamp mounted on said emergency power pack housing;

iii. an emergency electric power supply located within said emergency power pack housing and operationally connected to said at least one low voltage emergency lamp for supplying power to said at least one low voltage emergency lamp; and iv. an emergency electric power circuit within said emergency power pack housing for detecting failure of said primary electric power circuit and for switching to said emergency electric power supply; and E. an access plate mountable on said housing when said emergency illumination means is not mounted within said enclosure, wherein said exit sign housing and said emergency power pack housing are dimensionally sized so as to prevent relative movement therebetween when said emergency illumination means is fully inserted in said enclosure, one of said exit sign housing and said emergency power pack housing includes a dovetailed male member and the other of said exit sign housing and said emergency power pack housing has a dovetailed reception area within which said dovetailed male member is slideably receivable.

27. The exit sign kit in accordance with claim 26, wherein said dovetailed male member is on said emergency power pack housing.

28. The exit sign kit in accordance with claim 27, wherein said emergency electric power circuit includes a test switch and indicator light and said dovetailed male member includes at least one aperture through which said test switch and said indicator light protrude so as to be externally accessible through said emergency power pack housing.

29. The exit sign kit in accordance with claims 28, wherein said exit sign housing has at least one access opening defined therein to provide access to said test switch and indicator light when said emergency illumination means is fully inserted in said enclosure.

30. The exit sign kit in accordance with claim 29, wherein said access plate is provided with a dovetailed shape so as to be slideably receivable within said dovetailed reception area to cover said at least one access opening.

* * * * *

UNITED STATES PATENT AND TRADEMARK OFFICE

CERTIFICATE OF CORRECTION

PATENT NO. : 5,768,814

DATED : June 23, 1998

INVENTOR(S) : Edward P. Kozek and Robert M. Johnstone

It is certified that error appears in the above-identified patent and that said Letters Patent is hereby corrected as shown below:

In Column 3, line 62, "is" should be --18--.

In Column 5, line 6, after "76", --,-- should be inserted.

In claim 1, line 24 (Column 6, line 35), "back" should be --pack--.

In claim 6, line 1 (Column 6, line 64), "-" should be deleted.

In claim 9, line 16 (Column 7, line 27), "sad" should be --said--.

In claim 9, line 20 (Column 7, line 31), after ";", --and-- should be inserted.

In claim 9, line 27 (Column 7, line 37), after "frame", --,-- should be inserted.

In claim 11, line 10 (Column 7, line 65), before "at", --i.-- should be inserted.

UNITED STATES PATENT AND TRADEMARK OFFICE

CERTIFICATE OF CORRECTION

PATENT NO. : 5,768,814
DATED : June 23, 1998
INVENTOR(S) : Edward P. Kozek and Robert M. Johnstone It is certified that error appears in the above-identified patent and that said Letters Patent is hereby corrected as shown below:

In claim 15, line 25 (Column 8, line 67), "ine" should be --one--.

In claim 17, line 2 (Column 9, line 22), "function" should be --junction--.

In claim 17, line 4 (Column 9, line 24), "a next" should be --an exit--.

In claim 17, line 14 (Column 9, line 34), after "ii", --.-- should be inserted.

In claim 17, line 19 (Column 9, line 39), after "exit", --sign-- should be inserted.

In claim 29, line 1 (Column 12, line 19), "claims" should be --claim--.

Signed and Sealed this

Eighth Day of September, 1998

Bruce Lehman

*Attest:*

BRUCE LEHMAN

*Attesting Officer*

*Commissioner of Patents and Trademarks*